US010543487B2

(12) United States Patent
Viilo

(10) Patent No.: US 10,543,487 B2
(45) Date of Patent: Jan. 28, 2020

(54) JAW CRUSHER, CRUSHING PLANT AND CRUSHING METHOD

(71) Applicant: Metso Minerals, Inc., Helsinki (FI)

(72) Inventor: Keijo Viilo, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 553 days.

(21) Appl. No.: 15/036,146

(22) PCT Filed: Nov. 14, 2013

(86) PCT No.: PCT/FI2013/051074
§ 371 (c)(1),
(2) Date: May 12, 2016

(87) PCT Pub. No.: WO2015/071525
PCT Pub. Date: May 21, 2015

(65) Prior Publication Data
US 2016/0288127 A1 Oct. 6, 2016

(51) Int. Cl.
*B02C 1/04* (2006.01)
*B02C 1/02* (2006.01)
(Continued)

(52) U.S. Cl.
CPC ..... *B02C 1/04* (2013.01); *B02C 1/02* (2013.01); *B02C 1/06* (2013.01); *B02C 21/02* (2013.01)

(58) Field of Classification Search
USPC .... 241/198.1, 208, 214, 215, 217, 223, 231, 241/241.5, 263, 264, 266, 267
See application file for complete search history.

(56) References Cited

U.S. PATENT DOCUMENTS 2,173,862 A * 9/1939 Rowe ..... B02C 1/04 241/14
2,257,388 A 9/1941 Krider
(Continued)

FOREIGN PATENT DOCUMENTS

CH 217566 10/1941
DE 2606858 B1 * 8/1977 ..... B02C 1/04
(Continued)

OTHER PUBLICATIONS

International Search Report for International Application No. PCT/FI2013/051074 dated Feb. 27, 2014.
(Continued)

*Primary Examiner* — Shelley M Self
*Assistant Examiner* — Jared O Brown
(74) *Attorney, Agent, or Firm* — Andrus Intellectual Property Law, LLP

(57) ABSTRACT

A jaw crusher including a fixed jaw and a movable jaw for forming a crushing chamber therebetween which is open at the top, the fixed jaw including a first wear part mounted thereto and the movable jaw including a pitman and a second wear part mounted thereto. The crushing chamber includes an upper section, a middle section, and a lower section having equal heights (h). The pitman is bearing-mounted to an eccentric shaft and to at least one slide member. The at least one slide member is configured to slide in a direction substantially perpendicular to the vertical diagonal of the crushing chamber. A method for crushing mineral material in a jaw crusher or a crushing plant is also disclosed.

19 Claims, 5 Drawing Sheets

(51) Int. Cl.
*B02C 21/02* (2006.01)
*B02C 1/06* (2006.01)

(56) References Cited

U.S. PATENT DOCUMENTS

| | | | | |
|---|---|---|---|---|
| 2004/0035963 | A1 | 2/2004 | Nuora et al. | |
| 2014/0048636 | A1* | 2/2014 | Zhu | B02C 1/04 241/267 |

FOREIGN PATENT DOCUMENTS

| | | | |
|---|---|---|---|
| GB | 275100 | | 8/1927 |
| GB | 275100 | A | 8/1927 |
| JP | S63-141639 | U | 9/1988 |
| JP | H05-154405 | A | 6/1993 |
| JP | H07-313891 | A | 12/1995 |
| JP | 3052632 | U | 9/1998 |

OTHER PUBLICATIONS

Written Opinion for International Application No. PCT/FI2013/051074 dated Feb. 27, 2014.
International Preliminary Report on Patentability for International Application No. PCT/FI2013/051074 dated Mar. 3, 2016.
Notice of Allowance for Japanese Patent Application No. 2016-530001 dated Apr. 16, 2018.

* cited by examiner

JAW CRUSHER, CRUSHING PLANT AND CRUSHING METHOD

CROSS-REFERENCE TO RELATED APPLICATIONS

This application claims priority to PCT/FI2013/051074, filed Nov. 14, 2013, and published in English on May 21, 2015 as publication number WO 2015/071525, incorporated herein by reference.

TECHNICAL FIELD

The invention relates to a jaw crusher and a processing plant and a crushing method which are suitable for mineral material crushing.

BACKGROUND ART

The function of a jaw crusher is based on a force which is compressing the rock. An eccentric shaft is attached to a body of the jaw crusher to which eccentric shaft is connected a movable jaw, i.e. a pitman, making an eccentric movement relative to a fixed jaw. For moving the pitman of the jaw crusher two main types are known in which two toggle plates, a so called double toggle, or one toggle plate, a so called single toggle, are used in the movement mechanism of the pitman.

In the double toggle type jaw crusher the eccentric shaft is connected between two toggle plates to move one end of the pitman (for example, a bottom end in a Blake-crusher) and a second end of the pitman is pivoted to the body of the crusher. In a double toggle crusher of a so called overhead pivot-type the pivot in the upper end of the pitman is located on a bisector of the crushing chamber wherein a stroke is formed in the upper portion of the crushing chamber which is larger than the stroke in the conventional Blake-crusher, and the stroke is in a more perpendicular direction relative to the fixed jaw. The stroke has a form of a large arc.

The single toggle type crusher is simpler than the double toggle type crusher. In the single toggle crusher one end of the pitman is pivoted through the eccentric shaft to the body of the crusher and the second end of the pitman is pivoted to the body of the crusher through the toggle plate. When the upper end of the pitman is pivoted by the eccentric shaft (a crusher of overhead eccentric type), a movement shape of the movable jaw is almost a circle in the upper portion of the crushing chamber because it is near the eccentric shaft. Then the stroke in the bottom portion of the crushing chamber has a form of a narrow ellipse and the movement shape is getting upwards more and more a form of a circle in the crushing chamber.

In the single toggle crushers the powerful stroke in the upper and centre portions of the crushing chamber is problematically short because of the form of the movement shape. A large part of the compression movement is directed inclined upwards or downwards. The amount of crushing strokes for breaking a single stone is high because of the short stroke what is limiting capacity and is leading to pulverizing of the surface of the material to be crushed before the actual crushing. Fine material is not interesting economically and generating of the fine material is causing unnecessary energy consumption. The direction of the stroke is not optimal in the bottom portion of the crushing chamber but is directed upwards wherein the material to be crushed is moving vertically on the wear surfaces. Large stones which require a relative long compression distance are crushed in the upper portion of the crushing chamber. The stroke length in the upper portion of the known crusher is small relative to the stone size. Because the stroke is short in the upper portion of the crushing chamber of the crusher, many strokes are required before large stones are broken. The unfavorable stroke direction is wearing the jaws more than a stroke which is perpendicular to the bisector of the crushing chamber.

In the double toggle crushers the shape and direction of the stroke are better than in the single toggle crushers. On the other side the stroke is much smaller in the upper portion than in the lower portion of the crushing chamber and so the upper portion of the crushing chamber becomes easy the part which is limiting the capacity.

When the jaws are wearing the nip angle in the crushing chamber is increasing and may in some applications drop the capacity of the crusher substantially smaller.

GB275100 shows a stone crusher with a fixed crushing jaw and a movable crushing jaw driven by an eccentric. The movable jaw is hung on pivots horizontally displaceable in slideways.

An object of the invention is to create an alternative crusher by which drawbacks present in connection with known crushers can be eliminated or at least reduced.

SUMMARY

According to a first example aspect of the invention there is provided a jaw crusher comprising a fixed jaw and movable jaw for forming a crushing chamber therebetween which is open at the top, the fixed jaw comprising a first wear part mounted thereto and the movable jaw comprising a pitman and a second wear part mounted thereto; wherein the crushing chamber comprises an upper section, a middle section, and a lower section having equal heights; and the pitman is bearing-mounted to an eccentric shaft and to at least one slide member, and the at least one slide member is configured to slide in a direction substantially perpendicular to the vertical bisecting line of the crushing chamber.

Preferably a substantially horizontal line passing through the centre of the eccentric shaft passes through the middle section of the crushing chamber.

Preferably the substantially horizontal line passing through the centre of the eccentric shaft substantially passes through the centerline of the crushing chamber thus dividing the crushing chamber into two parts of equal height.

Preferably the substantially horizontal line passing through the centre of the eccentric shaft passes through the location of the at least one least one slide member.

Preferably the slide member is configured receive vertically both compression and tension forces.

Preferably the at least one slide member is configured to slide between a lower slide surface and an upper slide surface which are directed towards said slide member and configured to maintain a linear movement path of the pitman in the attachment region of the slide member.

Preferably the slide member is arranged to move relative to the pitman or relative to side plates of the jaw crusher; and a fixing member attached to said slide member is correspondingly attached to the side plates or to the pitman.

Preferably the vertical bisecting line of the crushing chamber has the direction of the gravitation.

Preferably a first slide member is arranged between the vertical bisecting line of the crushing chamber and the eccentric shaft.

Preferably the jaw crusher further comprises a second slide member which is arranged behind the eccentric shaft when viewed from the direction of the first slide member.

Preferably the jaw crusher comprises a third slide member which is arranged between the eccentric shaft and the pitman.

Preferably the third slide member is configured to transfer the eccentric movement of the eccentric shaft to the horizontal movement of the pitman.

Preferably the jaw crusher comprises a crank connected between the eccentric of the eccentric shaft and a fixing member of the first or second slide member.

Preferably a rotatable eccentric element such as an eccentric sleeve is bearing-mounted between the pitman and the eccentric of the eccentric shaft which is located in the front end of the pitman close to the crushing chamber; and the eccentricity and rotational speed of the eccentric element and the eccentric shaft are arranged equal so that a linear movement of the pitman is achieved.

Preferably the slide member is arranged behind the eccentric shaft when viewed from the direction of the crushing chamber.

Preferably the jaw crusher comprises a safety device with lower and upper hydraulic cylinders with a specific safety pressure limit arranged to support vertically the at least one slide member.

Preferably a first distance between the eccentric shaft and the first slide member is arranged substantially larger than a second distance between the vertical bisecting line of the crushing chamber and the first slide member.

Preferably the jaw crusher comprises adjusting apparatuses of setting and jaw angle which are located in an upper end and a lower end of the fixed jaw.

According to a second example aspect of the invention there is provided a crushing plant which comprises a jaw crusher according to any embodiment of the invention.

According to a third example aspect of the invention there is provided a method for mineral material crushing in a jaw crusher or a crushing plant which jaw crusher or crushing plant comprises a fixed jaw and a movable jaw for forming a crushing chamber therebetween which is open at the top, the fixed jaw comprising a first wear part mounted thereto and the movable jaw comprising a pitman and a second wear part mounted thereto; wherein the crushing chamber comprises an upper section, a middle section, and a lower section having equal heights; and the pitman is bearing-mounted to an eccentric shaft and to at least one slide member, wherein directing a substantially linear crushing stroke to the material to be crushed in the crushing chamber by sliding the at least one slide member of the movement mechanism of the jaw crusher in a direction substantially perpendicular to the vertical bisecting line of the crushing chamber.

Preferably in the movement mechanism of the jaw crusher a substantially horizontal line passing through the centre of the eccentric shaft passes through the middle section of the crushing chamber.

Preferably receiving with said slide member vertically both compression and tension in different load situations.

Preferably sliding the at least one slide member between a lower slide surface and an upper slide surface which are directed towards said slide member and maintaining a linear movement path of the pitman in the attachment region of the slide member.

Preferably moving the slide member relative to the pitman or relative to side plates of the jaw crusher.

Preferably coupling the eccentric movement of the eccentric shaft by a crank to the slide member.

Preferably the setting and the jaw angle of the jaw crusher are adjusted by adjustment apparatuses which are located in an upper end and a lower end of the fixed jaw. Preferably the adjustment apparatuses are located between the body (a front end) of the jaw crusher and wear parts of the fixed jaw. Preferably overload protecting devices are integrated in the adjustment apparatuses.

According to initial testing the production capacity of the invented crusher is clearly higher than with traditional single toggle crushers. Coarse estimated have been presented that wearing of the wear parts is quarter compared to traditional wear. A critical jaw angle may be wider due to the good movement path of the movable jaw.

The power used by the jaw crusher per crushed amount of mineral material can be smaller than in known applications because lesser energy is used in the crushing event for moving vertically the material to be crushed between the jaws. A larger crushing volume can be gained by the same crushing power because a larger portion of the power can be directed to crushing of the mineral material instead of grinding material with the relative vertical movement of the jaws.

The movement mechanism enables an optimal stroke in a direction perpendicular to the vertical bisecting line of the crushing chamber. At the same time the stroke is almost or entirely constant in the region of the whole crushing chamber and so also a sufficient stroke is gained to the upper and centre portions of the crushing chamber. In the upper portion of the crushing chamber the stroke is increasing compared to the double toggle-type crushers and crushing probability of large blocks is increasing. Then, lesser work cycles are required and the capacity of the upper portion of the crushing chamber is increasing. The whole crushing chamber can work more evenly in practice. Wearing of the jaws is lesser than in conventional crushers because the stroke is almost perpendicular to the bisector of the crushing chamber. By the adjustment of the fixed jaw in the upper and/or lower portion it is possible, in addition to the adjustment of the setting, to change if desired also the jaw angle without additional parts. At the same time the jaw angle can be held constant during the total lifetime of the jaws. The jaw angle can be adjusted convenient for each rock material.

Location of the fly wheels now substantially lower than in the prior art is reducing the total height of the crusher and the crushing plant. A more compact crusher enables feeding also from the direction of the movable jaw "against the fixed jaw". This situation is more advantageous than against the movable jaw wherein a large stone against the movable jaw may cause large forces to the structures of the crusher.

A more optimal movement shape is reducing wear of the crusher and the wear parts, increasing capacity and reducing energy consumption.

The more compact size of the crusher is enabling greater flexibility than before in the design of the crushing plant (a more compact plant).

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying schematical drawings, in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
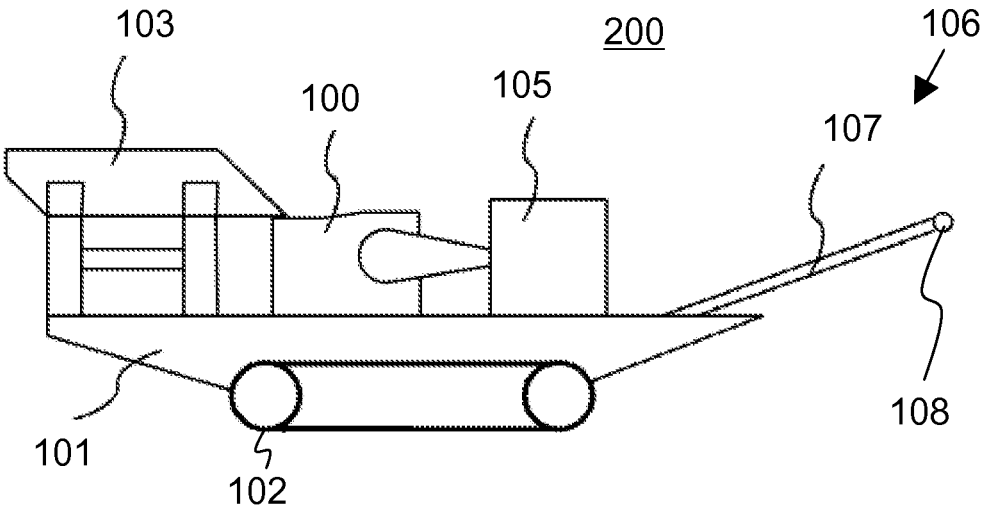
FIG. 1 shows a side view of a crushing plant which is suitable for mineral material crushing.

FIG. 1 shows a mineral material processing apparatus, a crushing plant 200 which comprises a jaw crusher 100. The crushing plant 200 has a feeder 103 for feeding the material to the jaw crusher 100 and a belt conveyor 106 for transporting the crushed material farther from the crushing plant.

The belt conveyor 106 shown in FIG. 1 comprises a belt 107 which is adapted to pass around at least one roller 108. The crushing plant 200 comprises also a power source and a control unit 105. The power source can be for example a diesel or an electric motor which is providing energy for process units and hydraulic circuits.

The feeder 103, the crusher 100, the power source 105 and the conveyor 106 are attached to a body 101 of the crushing plant which body in this embodiment comprises additionally a track base 102 for moving the crushing plant 200. The crushing plant can also be wholly or partly wheel based or movable on legs. Alternatively it can be movable/towable for example by a truck or another external power source. Alternatively the crushing plant can be a fixed plant.

The mineral material may be for example mined rock or it may be asphalt or construction demolition waste such as concrete or bricks etc. In addition to the above the crushing plant may also be a fixed plant.

Embodiments of movement mechanisms of a jaw crusher 100 shown in FIGS. 2 to 10 can be used for example in the crushing plant 200 of FIG. 1.

The jaw crusher 100 shown in FIGS. 1 to 10 comprises a fixed jaw and movable jaw for forming a crushing chamber 3 therebetween which is open at the top. A first wear part 1 is attached to the fixed jaw and a second wear part 2 is fixed to a pitman 4. In FIGS. 2 to 10, the fixed jaw is represented by the wear part 1 attached to the fixed jaw and the movable jaw is represented by the wear part 2 attached to a pitman 4. The crushing chamber 3 comprises an upper section 5, a middle section 6, and a lower section 7 having equal heights h. The movement mechanism of the jaw crusher is based on an attachment of the pitman 4 firstly to a rotatable eccentric shaft 8 and secondly to at least one slide member 9 configured to slide in a direction substantially perpendicular to the vertical bisecting line 10 of the crushing chamber 3. Preferably a substantially horizontal line 11 passing through the centre of the eccentric shaft 8 passes through the middle section 6 of the crushing chamber 3.

Preferably the substantially horizontal line 11 passing through the centre of the eccentric shaft 8 substantially passes through the horizontal centerline 3' of the crushing chamber 3 thus dividing the crushing chamber into two parts of equal height H.

The eccentric shaft 8 is rotatably bearing-mounted on the one hand at a first support point to the pitman 4 and on the other hand to a body (not shown in the Figures) of the jaw crusher. The eccentricity of the eccentric shaft is used to create the stroke of the pitman 4 and thus the movable jaw. Preferably the eccentricity of the eccentric shaft 8 is equal a half of the stroke length of the movable jaw.

The pitman 4 is additionally supported to the body 2 at least at a second support point by at least one slide member 9. Preferably the at least one slide member 9 is configured to slide (relative to the body of the crusher) between a lower slide surface 12 and an upper slide surface 13 which are directed towards the slide member 9. The upper slide surface eliminates an upwards directed movement of the slide member 9 and the lower slide surface eliminates a downwards directed movement of the slide member 9 thus maintaining a linear movement path of the pitman in the attachment region of the slide member.

Figure 10:
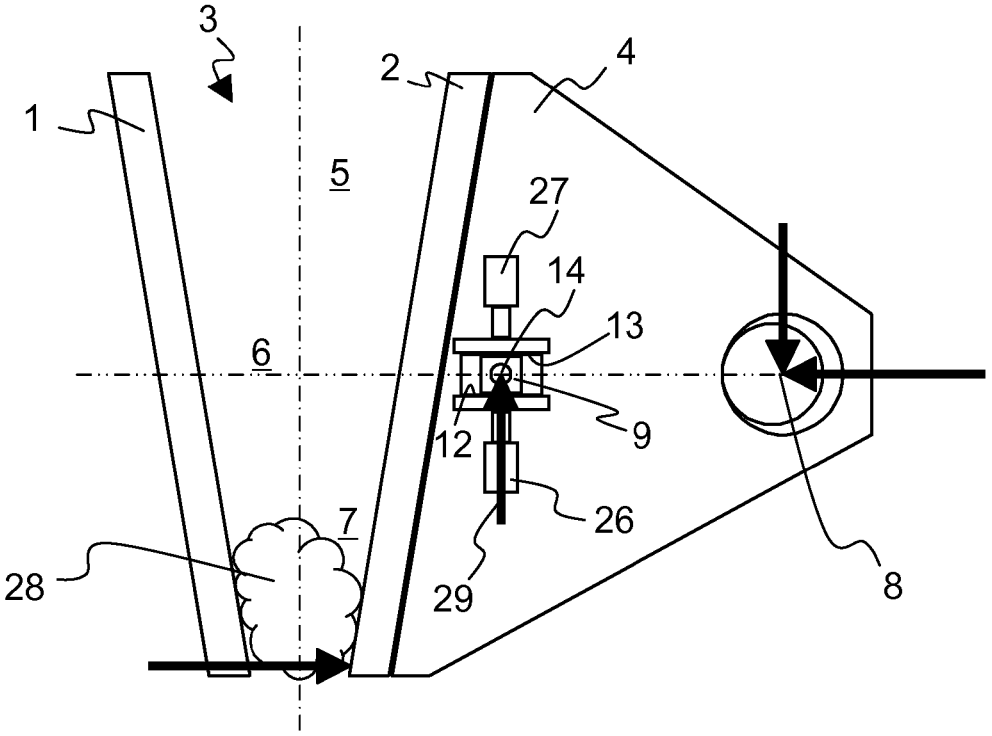
FIG. 10 shows an example of a safety device according to a first preferable embodiment of the invention presented with the movement mechanism of FIG. 2.

The slide member 9 is configured to receive both compression and tension in different load situations, in other words to receive forces directed both upwards and downwards, depending on the location of crushable material in upper locations or lower locations of the crushing chamber 3 and the force resultant resulting therefrom (see also FIG. 10).

Figure 2:
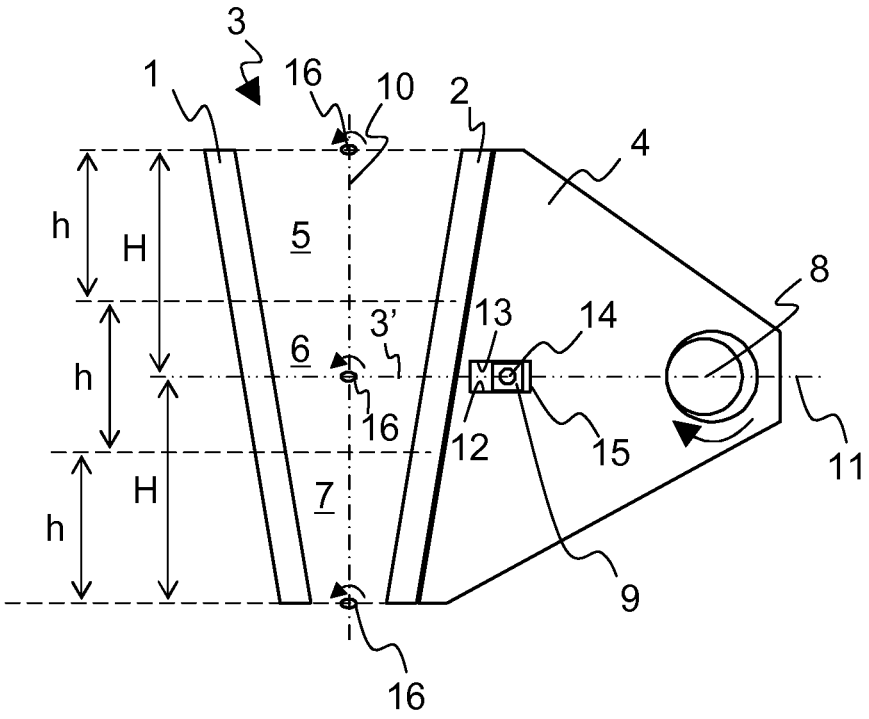
FIG. 2 shows a side view of a movement mechanism according to a first preferable embodiment of the invention.

The slide member 9 is preferably located horizontally as close as possible the wear surface of the wear part 2 of the pitman 4 wherein a very short vertical movement can be gained for the movable jaw in FIG. 2. The decreasing vertical movement of the wear surface of the pitman relative to the fixed jaw is reducing the power required from the crusher when the material to be crushed must not be abraded vertically between the jaws.

The closer the attachment of the slide member 9 to the pitman 4 is brought to the wear surface of the second wear part 2, more preferably to the vertical bisecting line 10 of the crushing chamber 3, the closer to the wear surface can also the eccentric shaft 7 be brought and the crusher can be shortened. The crusher can be lowered and a compact crusher can be generated when the eccentric shaft and, if necessary, a flywheel connected to it can be brought lower than in the typical single toggle crusher.

Preferably the vertical bisecting line 10 of the crushing chamber 3 has the direction of the gravitation as shown in the FIGS. 2 to 8 and 10. Thus the crushing chamber 3 can be constructed so that the wear parts 1, 2 of the fixed jaw and the movable jaw wear equally, for example when the opposite wear parts 1, 2 have the equal inclination angle in opposite directions relative to the vertical. Generally the vertical bisecting line 10 of the crushing chamber 3 has the direction of a line which halves the nip angle in the crushing chamber 3, i.e. the direction of a bisector of the crushing chamber. The figures of this description are drawn in the preferable situation when the bisector of the crushing chamber has the direction of the gravitation.

In mineral material crushing the opening of the crushing chamber must in practice have a certain size for example for feeding stones to the crushing chamber. By the jaw angle adjustment of the crushing chamber the efficient crushing can be affected such that the material to be crushed is kept in place and does not move upwards on the surfaces of the wear parts which are fixed to the fixed jaw and to the pitman. The pitman 4 can be moved substantially perpendicularly relative to the vertical bisecting line 10 of the crushing chamber 3 when there is crushed with crushers according to preferable embodiments of the invention wherein the jaw angle can in some cases be increased compared to prior art. Then, the crusher can also be lowered if necessary.

The setting and the jaw angle of the jaw crusher can be adjusted by adjusting apparatuses (not shown in the Figs.) which are preferably located in an upper end and a lower end of the fixed jaw. Preferably overload protecting devices are integrated in these adjustment apparatuses.

The movement mechanism of the movable jaw enables an optimal stroke in a direction perpendicular to the vertical bisecting line 10 of the crushing chamber 3. In the embodiments shown in FIGS. 2 to 8 the stroke is almost constant and in FIGS. 3 to 9 additionally linear in the region of the whole crushing chamber.

FIG. 2 shows a side view of a movement mechanism according to a first preferable embodiment. A shaft 14 or a corresponding fixing member attached on the one hand to the slide member 9 is attached on the other hand to the pitman 4 or to side plates of the body of the crusher. Correspondingly, the slide member 9 moves relative to the side plates or the pitman. Preferably the slide member 9 moves in a hole 15 made to the side plates or the pitman. The hole comprises preferably two opposite slide surfaces 12, 13 adapted to be in close contact with the slide member 9.

The movement path 16 of the movable jaw 2 in the crushing chamber is elliptic in FIG. 2 where the eccentric shaft 8 lifts and lowers the rear end of the pitman where the eccentric shaft is located. The longitudinal axis of the movement path 16 is perpendicular to the vertical bisecting line 10 of the crushing chamber 3. When the slide member 9 is brought as close as possible to the vertical bisecting line of the crushing chamber the movement path 16 is flattest and the undesired vertical movement of the fixed and movable jaws relative to each other is minimized.

The location of the eccentric shaft on the substantially horizontal line 11 passing through the middle section 6 of the crushing chamber 3 creates symmetric movement paths 16 of the movable jaw in the upper and lower sections 5 and 7 of the crushing chamber 3.

In FIG. 2 the eccentric shaft 8 is optimally configured to rotate clockwise, i.e. the eccentric portion of the eccentric shaft moves upwards on the side of the crushing chamber 3 shown by an arrow below the eccentric shaft. Said rotation direction of the eccentric shaft 8 produces with the described movement mechanism a counter clockwise direction of the movement paths 16 shown by arrows above the movement paths.

Figure 3:
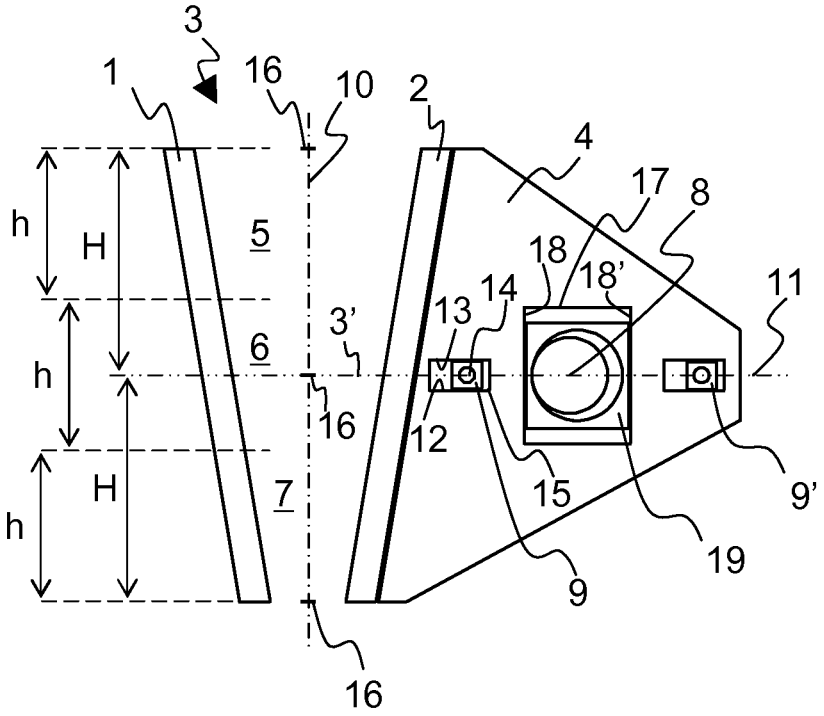
FIG. 3 shows a side view of a movement mechanism according to a second preferable embodiment of the invention.

FIG. 3 shows a side view of a movement mechanism according to a second preferable embodiment. A fully linear movement path 16 of the movable jaw is achieved with (at least) two slide members configured to slide in a direction substantially perpendicular to the vertical bisecting line 10 of the crushing chamber. The jaw crusher of FIG. 3 comprises an additional slide member to the first slide member 9 shown in FIG. 2, namely a second slide member 9' in the rear end of the pitman 4, similar in function to the first slide member 9 described in FIG. 2, in contact with two opposite slide surfaces, and an additional third slide member 19 which is arranged between the eccentric shaft 8 and the pitman 4. Preferably the third slide member 19 is arranged to slide substantially vertically. The second slide member is arranged behind the eccentric shaft when viewed from the direction of the first slide member. The first and second slide members 9, 9' maintain the movement path of the movable jaw linear and keep the movable jaw in correct position moving preferably horizontally. The first 9 and second 9' slide members are moving relative to the side plates of the crusher or relative to the pitman. The first and second slide members are configured to receive both compression and tension in different load situations, in other words to receive forces directed both upwards and downwards, depending on the location of the crushing force resultant.

The third slide member 19 is configured to transfer the movement of the eccentric to the movement of the pitman in a direction substantially perpendicular to the vertical bisecting line 10 of the crushing chamber. More particularly, the third slide member 19 is configured to transfer the eccentric movement of the eccentric shaft to the horizontal movement of the pitman 4 and preferably to eliminate the vertical movement component of the eccentric shaft 8. The third slide member 19 slides at the side of the pitman 4, preferably in an opening 17 in the pitman. The pitman 4, preferably the opening 17 comprises third 18 and fourth 18' slide surfaces which are directed towards the third slide member 19 and adapted to be in close contact with the third slide member.

A preferred location of all slide members 9, 9', 19 (also the eccentric shaft 8) is on a line 11 perpendicular to the vertical bisecting line 10 of the crushing chamber 3 and vertically in the height of the horizontal centerline 3' of the crushing chamber. Alternative locations of the first and second slide members are described in connection with FIGS. 6 and 7.

When the substantially horizontal line 11 passes through the support points of the pitman 4, preferably through the first and second slide members, and through the middle section 6 of the crushing chamber 3, the first and second slide members receive forces directed towards the upper and lower section and any detaching of the first and second slide members from contact with the lower and upper surfaces is eliminated.

Figure 4:
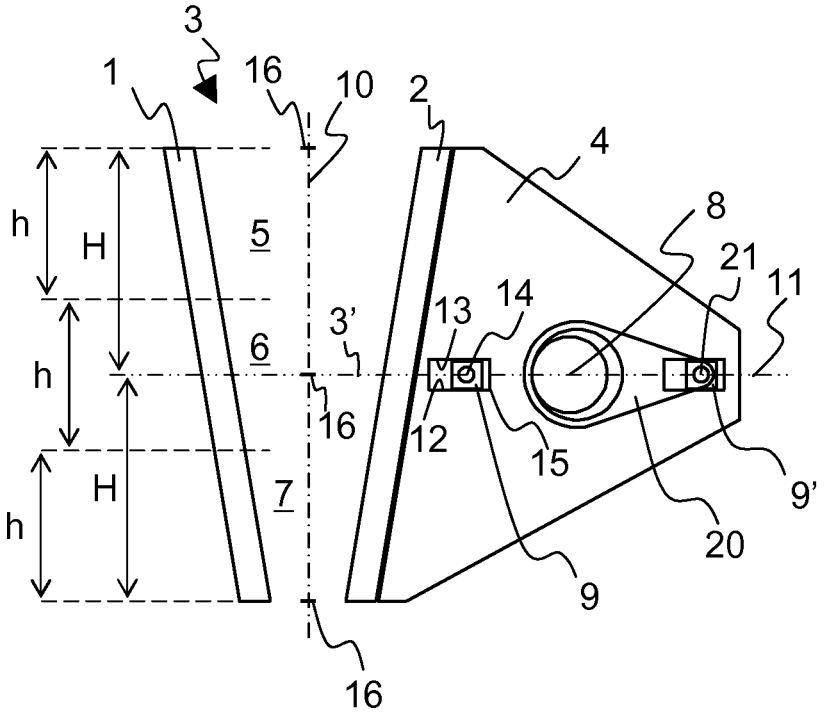
FIG. 4 shows a side view of a movement mechanism according to a third preferable embodiment of the invention.

FIG. 4 shows a side view of a movement mechanism according to a third preferable embodiment of the invention. A fully linear movement path 16 of the movable jaw is achieved with the first and second slide members 9, 9' like in FIG. 3. The crushing movement of the movable jaw of FIG. 4 is produced by the eccentric shaft 8 and a crank mechanism comprising a crank 20 connected between the eccentric of the eccentric shaft and the fixing member such as a shaft 21 of the second slide member 9'. The crank mechanism is configured to transfer the eccentric movement of the eccentric shaft to the horizontal movement of the pitman 4 and to cut off the vertical movement component of the eccentric shaft 8.

The first and second slide members 9, 9' maintain the movement path of the movable jaw linear and keep the movable jaw in correct position. The first 9 and second 9' slide members are moving relative to the side plates of the crusher or relative to the pitman. The first and second slide members are configured to receive both compression and tension in different load situations, in other words to receive forces directed both upwards and downwards, depending on the location of the crushing force resultant.

A preferred location of the two slide members 9, 9' and the eccentric shaft 8 is on a line 11 perpendicular to the vertical bisecting line 10 of the crushing chamber 3 and vertically in the height of the horizontal centerline 3' of the crushing chamber. Alternative locations of the first and second slide members are described in connection with FIGS. 6 and 7.

Figure 5:
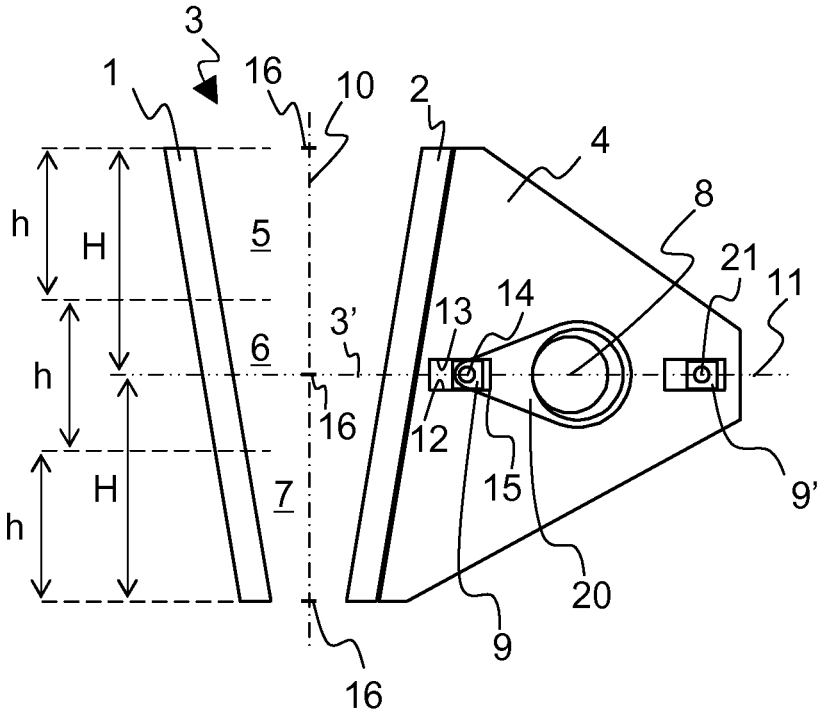
FIG. 5 shows a side view of a movement mechanism according to a fourth preferable embodiment of the invention.

The movement mechanism in FIG. 5 is basically like the movement mechanism in FIG. 4 but the crank 20 is pivoted to the fixing member 14 of the first slide member 9 instead of the fixing member 21 of the second slide member 9'. Same advantages for the movement are achieved as in FIG. 4. Naturally the crank can be coupled to both the first and the second slide members.

Figure 6:
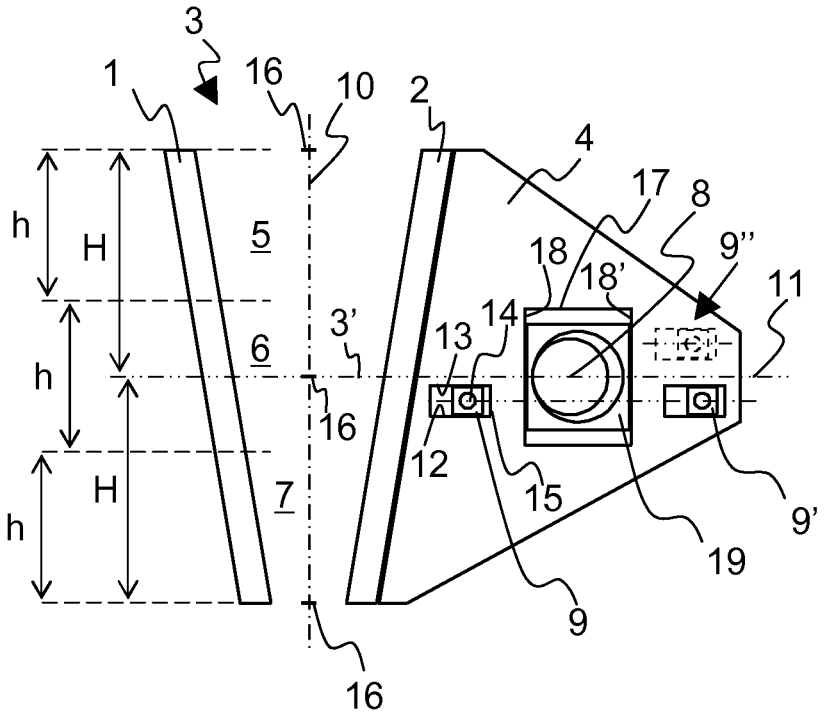
FIG. 6 shows an alternative jaw crusher similar to the jaw crusher in FIG. 3.
Figure 7:
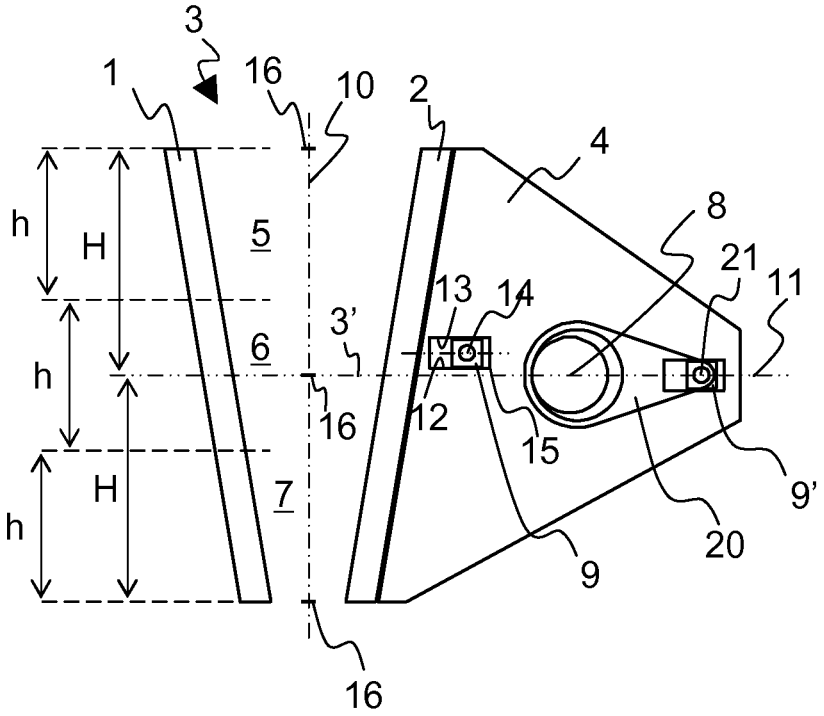
FIG. 7 shows an alternative jaw crusher similar to the jaw crushers in FIGS. 4 and 5.

FIGS. 6 and 7 show alternative jaw crushers similar to the jaw crushers in FIGS. 3 to 5 in that the jaw crushers comprise two slide members configured to slide in a direction substantially perpendicular to the vertical bisecting line 10 of the crushing chamber.

In the example of FIG. 6 the first and second slide members 9, 9' of the second embodiment of the jaw crusher are located on same vertical height but on a different vertical height level than the eccentric shaft 8. In FIG. 6 a further alternative for a different height location of a slide member is depicted with a dashed line and denoted with a reference numeral 9". The first and second slide members may also be located on different vertical height levels when they are configured to slide in a direction substantially perpendicular to the vertical bisecting line of the crushing chamber. The height level examples described in accordance with FIG. 6 can also be applied with the third and fourth embodiments of the jaw crusher.

In the example of FIG. 7 the first and second slide members 9, 9' of the third embodiment of the jaw crusher are located on different vertical heights. In the example of FIG. 7 one of the slide members is located on same height level as the eccentric shaft 8. The height level examples described in accordance with FIG. 7 can also be applied with the second embodiment of the jaw crusher.

Figure 8:
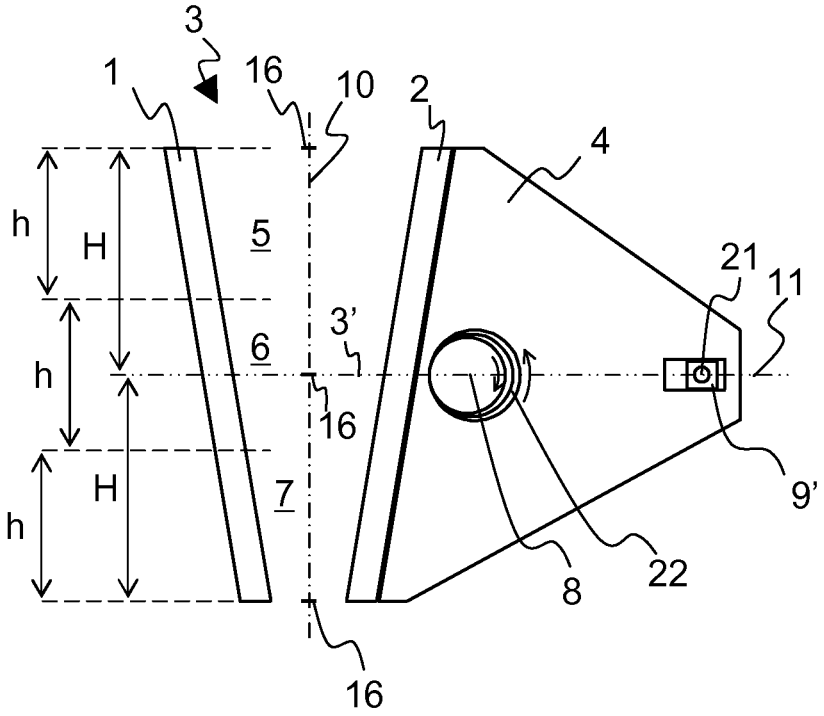
FIG. 8 shows a side view of a movement mechanism according to a fifth preferable embodiment of the invention.

The fifth preferable embodiment of the movement mechanism shown in FIG. 8 comprises an additional eccentric element 22 such as an eccentric sleeve mounted around the eccentric of the eccentric shaft 8 which is located in the front end of the pitman 4 close to the crushing chamber or the second wear part 2. The second eccentric element 22 is configured to rotate (a rotating device 23 in FIG. 9) in an opposite rotation direction than the eccentric shaft 8 as is denoted with the opposite directed arrows in FIG. 8. Preferably the eccentricity and rotational speed of both eccentric elements 8 and 22 are arranged equal so that a fully linear and horizontal movement path 16 of the movable jaw is achieved.

The two eccentrics 8, 22 joined together and the second slide member 9' maintain the movement path of the movable jaw linear and keep the movable jaw in correct position. The second 9' slide member is moving relative to the side plates of the crusher or relative to the pitman. The two eccentrics 8, 22 joined together and the second slide member 9' are configured to receive both compression and tension in different load situations, in other words to receive forces directed both upwards and downwards, depending on the location of the resultant of the crushing forces in the crushing chamber 3.

Figure 9:
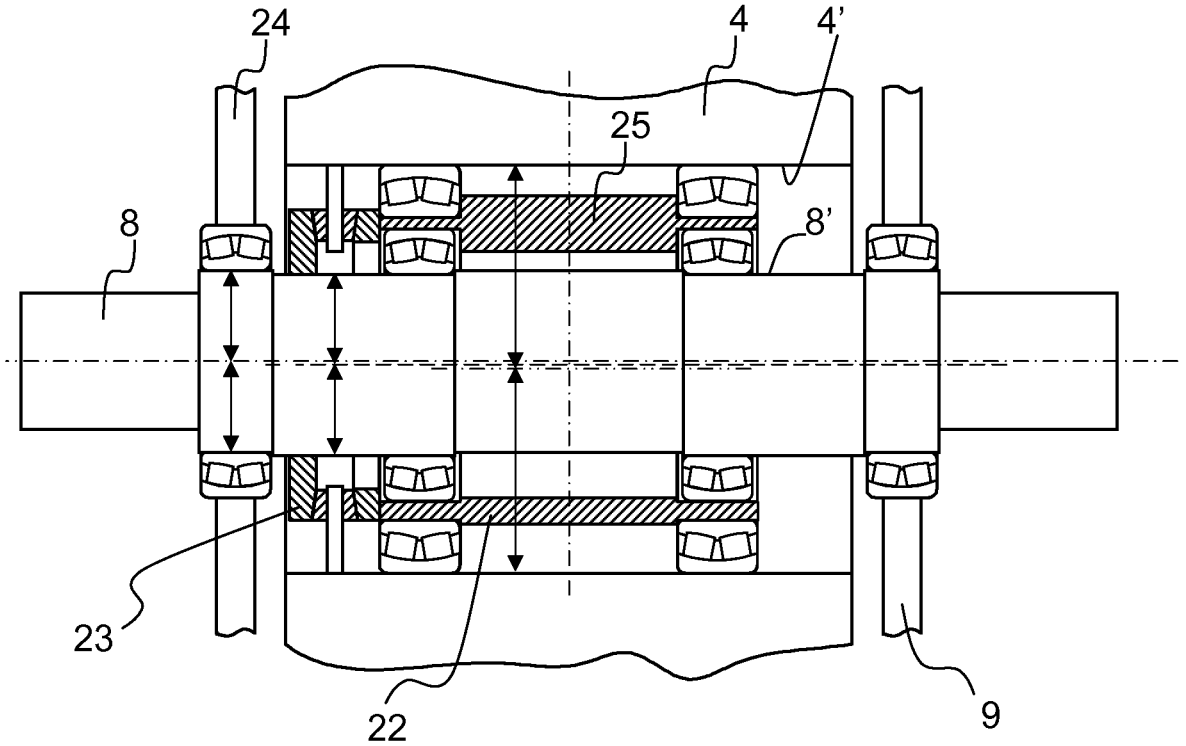
FIG. 9 shows a cross section of a preferable eccentric arrangement of the movement mechanism shown in FIG. 8.

FIG. 9 shows a cross section of an example eccentric arrangement of the movement mechanism shown in FIG. 8. The eccentric shaft 8 is bearing-mounted to the body such as the side plates 24 of the jaw crusher 100. Firstly, the eccentric sleeve 22 is bearing-mounted to and around the eccentric 8' of the eccentric shaft 8, and secondly inside a hole 4' of the pitman 4. The rotating device 23 is coupled with the pitman 4 and the eccentric sleeve 22 having an example counterbalance 25.

FIG. 10 shows an overload safety device 26, 27 with the movement mechanism of FIG. 2. The safety device comprises lower and upper hydraulic cylinders 26, 27 with a specific safety pressure limit arranged to support vertically the slide member 9, preferably through the lower and upper slide surfaces 12, 13. Typically a resultant of the crushing force is caused in the upper section 5 (for example a large stone) or in the lower section 7 (for example a metal piece or packing of fine material) of the crushing chamber 3 wherein the slide member 9 (and/or second slide member 9') receives high vertical forces. In the example of FIG. 9 material 28 is packed in the lower section 7 of the crushing chamber wherein the lower hydraulic cylinder 26 supports the slide member 9 with a vertical force 29.

Preferably the aforementioned hydraulic cylinder 26, 27 arrangement is configured to maintain appropriate the clearances between the slide member 9 (and/or second slide member 9') and the lower and upper surfaces 12, 13 during normal operation.

According to another example of a safety device the fixing shaft 14, 21 of a first 9 and/or second 9' slide member dimensioned to a specific shear force.

The invention enables creating a very optimal movement path 16 of the movable jaw of the jaw crusher 100 in terms of efficiency and wear of the wear parts. A substantially linear movement can be achieved which is perpendicular to the vertical bisecting line of the crushing chamber and has equal size all over the crushing chamber. A sufficient stroke is achieved in the upper portion of the crushing chamber so that also large stones are crushed with a required ultimate compressive strain about 0.2%. The large stroke in the lower section of the crushing chamber increases capacity of the crusher 100 and the crushing plant 200. The linear stroke which is perpendicular to the vertical bisecting line of the crushing chamber wears minimally the wear parts.

All aforementioned movement mechanism alternatives use one or two slides having same sliding direction. The slides preferably bear forces two-sidedly. The horizontally moving slides preferably bear downwardly and upwardly directed forces. Preferably the slide and the eccentric shaft are located on the line passing through the middle section of the crushing chamber.

The application of FIG. 1 is quite simple and easy to implement with a relatively good movement path 16 in the entire region of the crushing chamber 3. If the crushing chamber is very high the stroke in the middle section 6 of the crushing chamber remains shorter than the stroke in the upper and lower sections 5, 7. Preferably a first distance between the eccentric shaft 8 and the first slide member 9 is arranged substantially larger than a second distance between the vertical bisecting line 10 of the crushing chamber and the first slide member 9. The larger said first distance is than said second distance the better the movement path.

In the alternatives of FIGS. 3 to 7 the movement path of the movable jaw is good but for example one more shaft 21 is needed. Preferably a balancing of the jaw crusher is implemented easily because the movement of the movable jaw is linear and there exists no swinging movement of the pitman.

The construction according to FIG. 8 is most optimal in terms of the operation. The movement is linear, perpendicular to the vertical bisecting line of the crushing chamber, and the stroke is equal in all sections of the crushing chamber 3.

Additionally the two concentric eccentric elements 8, 22 revolving in opposite directions enable to fully balance the crusher 100. The balancing of a crusher having an 800 mm wide jaw and two fly wheels can be implemented by mounting an about 10 kg mass to each flywheel and one 75 kg counterbalance 25 to the eccentric sleeve 22. This further enables to rigidly fix the fixed jaw to the movable crushing plant 200, and preferably to use the side plates as load bearing parts of the movable crushing plant.

Because of the increasing capacity the crusher with the described movement mechanism can preferably be operated as a second stage crusher. According to an example the length of the opening of the crushing chamber in the longitudinal direction of the crushing plant is 300 mm and the setting is 40 mm. With a nip angle of 24° the crushing chamber 3 is only about 600 mm high. In mobile assemblies this provides advantages with wide jaws.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of principles of the invention, and not in limitation thereof. Hence, the scope of the invention is only restricted by the appended patent claims.

The invention claimed is:

1. A jaw crusher comprising:

a fixed jaw and a movable jaw for forming a crushing chamber therebetween which is open at the top, the fixed jaw comprising a first wear part mounted thereto and the movable jaw comprising a pitman and a second wear part mounted thereto;

wherein the crushing chamber comprises an upper section, a middle section, and a lower section having equal heights;

wherein the pitman is coupled to an eccentric shaft and to at least one slide member such that a horizontal line passing through a center of the eccentric shaft passes through the middle section of the crushing chamber and through the at one least one slide member; and wherein the at least one slide member restricts the vertical movement of the pitman and the slide member is configured to slide along a linear movement path that is perpendicular to a vertical bisecting line of the crushing chamber in an attachment region between the at least one slide member and the pitman.

2. The jaw crusher of claim 1, wherein the horizontal line passing through the center of the eccentric shaft passes through the centerline of the crushing chamber thus dividing the crushing chamber into two parts of equal height.

3. The jaw crusher of claim 1, wherein the slide member is configured to receive vertically both compression and tension forces.

4. The jaw crusher of claim 1, wherein the slide member is arranged to move relative to the pitman or relative to side plates of the jaw crusher; and a fixing member attached to said slide member is correspondingly attached to the side plates or to the pitman.

5. The jaw crusher of claim 1, wherein the vertical bisecting line of the crushing chamber has the direction of the gravitation.

6. The jaw crusher of claim 1, wherein a first slide member of the at least one slide member is arranged between the vertical bisecting line of the crushing chamber and the eccentric shaft.

7. The jaw crusher of claim 6, wherein the jaw crusher further comprises a second slide member which is arranged behind the eccentric shaft when viewed from the direction of the first slide member.

8. The jaw crusher of claim 6, wherein the jaw crusher comprises a crank connected between an eccentric portion of the eccentric shaft and a fixing member of the first or second slide member.

9. The jaw crusher of claim 6, wherein a first distance between the eccentric shaft and the first slide member is arranged larger than a second distance between the vertical bisecting line of the crushing chamber and the first slide member.

10. The jaw crusher of claim 7, wherein the jaw crusher comprises a third slide member which is arranged between the eccentric shaft and the pitman.

11. The jaw crusher of claim 10, wherein the third slide member is configured to transfer the eccentric movement of the eccentric shaft to the horizontal movement of the pitman.

12. The jaw crusher of claim 1, wherein a rotatable eccentric element is coupled between the pitman and the eccentric portion of the eccentric shaft which is located at a front end of the pitman close to the crushing chamber, and wherein the eccentricity and rotational speed of the eccentric element and the eccentric shaft are arranged equal so that a linear movement of the pitman is achieved.

13. The jaw crusher of claim 12, wherein the slide member is arranged behind the eccentric shaft when viewed from the direction of the crushing chamber.

14. The jaw crusher of claim 1, wherein the jaw crusher comprises a safety device with lower and upper hydraulic cylinders coupled between the at least one slide member and the pitman, wherein the lower and upper cylinders are configured with a specific safety pressure limit arranged to support vertically the at least one slide member.

15. A crushing plant, wherein the crushing plant comprises the jaw crusher of claim 1.

16. A method for mineral material crushing in a jaw crusher or a crushing plant, the jaw crusher or the crushing plant comprising a fixed jaw and a movable jaw for forming a crushing chamber therebetween which is open at the top, the fixed jaw comprising a first wear part mounted thereto and the movable jaw comprising a pitman and a second wear part mounted thereto; wherein the crushing chamber comprises an upper section, a middle section, and a lower section having equal heights; wherein the pitman is coupled to an eccentric shaft and to at least one slide member, wherein a horizontal line passing through a center of the eccentric shaft passes through the middle section of the crushing chamber and through the at least one slide member; further comprising directing a linear crushing stroke to the material to be crushed in the crushing chamber by sliding the at least one slide member of the movement mechanism of the jaw crusher in a direction perpendicular to a vertical bisecting line of the crushing chamber, wherein the at least one slide member restricts the vertical movement of the pitman to sliding along a linear path in an attachment region between the at least one slide member and the pitman.

17. The method of claim 16, wherein the slide member is configured to vertically receive both compression and tension loads.

18. The method of claim 16, further comprising moving the slide member relative to the pitman or relative to side plates of the jaw crusher.

19. The method of claim 16, further comprising coupling the eccentric movement of the eccentric shaft by a crank to the slide member.

* * * * *